United States Patent [19]

Holley, Jr.

[11] Patent Number: 4,588,084

[45] Date of Patent: May 13, 1986

[54] ENCLOSED BOTTLE CARRIER FOR RETURNABLE BOTTLES

[75] Inventor: John M. Holley, Jr., Austell, Ga.

[73] Assignee: The Mead Corporation, Dayton, Ohio

[21] Appl. No.: 738,249

[22] Filed: May 28, 1985

[51] Int. Cl.[4] ..... B65D 75/00; B65D 5/46

[52] U.S. Cl. ..... 206/427; 206/428; 206/620; 206/813; 229/40; 229/52 B; 229/52 BC

[58] Field of Search ..... 206/141, 148, 162, 168, 206/177, 192, 199, 427, 605, 608, 613, 614, 620, 628, 631, 634, 813; 229/52 B, 52 BC, 38, 40

[56] References Cited

U.S. PATENT DOCUMENTS

| | | | |
|---|---|---|---|
| 2,723,027 | 11/1955 | Goyer | 229/52 B |
| 2,868,433 | 1/1959 | Anderson | 229/52 B |
| 3,167,214 | 1/1965 | Mahon | 206/628 |
| 3,306,517 | 2/1967 | Deisinger Jr. | 229/49 |
| 3,696,990 | 10/1972 | Dewhurst | 206/631 |
| 3,733,025 | 5/1973 | Hiersteiner | 206/613 |
| 3,829,006 | 8/1974 | Spiegel | 206/628 |
| 3,904,036 | 9/1975 | Forrer | 206/427 |
| 4,121,757 | 10/1978 | Hamlin | 229/52 B |
| 4,216,861 | 8/1980 | Oliff | 206/427 |
| 4,256,226 | 3/1981 | Stone | 206/614 |
| 4,318,474 | 3/1982 | Hasegawa | 206/199 |
| 4,360,106 | 11/1982 | Irvine et al. | 206/631 |
| 4,382,511 | 5/1983 | Hamelin et al. | 206/628 |
| 4,424,901 | 1/1984 | Lanier | 229/52 BC |
| 4,498,581 | 2/1985 | Dutcher | 229/52 BC |
| 4,508,258 | 4/1985 | Graser | 229/52 B |

*Primary Examiner*—Joseph Man-Fu Moy
*Assistant Examiner*—David T. Fidei
*Attorney, Agent, or Firm*—Rodgers & Rodgers

[57] ABSTRACT

A bottle carrier having foldably connected bottom and side walls is provided with a composite top wall formed of inner and outer overlapping panels foldably joined respectively to the upper edges of opposite side walls, portions of the overlapping face contacting surfaces of the inner and outer overlapping panels being secured together by glue while other portions of such overlapping surfaces are coated with a bond inhibiting substance such as varnish so as to facilitate delamination of such coated areas thereby to facilitate removal of a tear out section including parts of the composite top wall and upper portions of the side walls so as to facilitate use of the carrier as a container for returnable bottles, and the ends of the carrier being closed by closure structure including end flaps foldably joined to each end of the bottom side and top walls and folded inwardly.

8 Claims, 11 Drawing Figures

ENCLOSED BOTTLE CARRIER FOR RETURNABLE BOTTLES

TECHNICAL FIELD

This invention relates to totally enclosed bottle carriers which are specially adapted for use by the ultimate consumer as a means of returning returnable bottles such as beer or soft drink bottles to a point of purchase.

BACKGROUND ART

U.S. Pat. No. 3,904,036 issued Sept. 9, 1975 and owned by the assignee of this invention discloses and claims a fully enclosed bottle container generally similar to the enclosed carrier formed according to this invention.

DISCLOSURE OF THE INVENTION

According to this invention in one form, a totally enclosed bottle carrier for returnable bottles incorporates a composite top wall formed of overlapping face contacting inner and outer panels wherein certain overlapping face contacting areas of such inner and outer panels are secured together by suitable adhesive while other overlapping areas of the inner or outer panel are coated with a bond inhibiting substance whereby delamination of a portion of the outer panel from the inner panel is effected so that a tear out section defined by suitable tear lines may be removed to facilitate removal of bottles by the ultimate consumer and to facilitate reinsertion of the bottles into the carrier for the purpose of returning the bottles to a point of purchase. According to a feature of the invention, severance lines are formed in the upper corners of both side walls so that the end portions of the composite top wall together with end portions of a centrally separated handle may be elevated and folded outwardly thereby to facilitate machine removal of the bottles in the plant of the bottler following return of the bottles.

BRIEF DESCRIPTION OF THE DRAWINGS

In the drawings FIG. 1A shows one end of the blank from the outer surface thereof.

BEST MODE OF CARRYING OUT THE INVENTION

Figure 1:
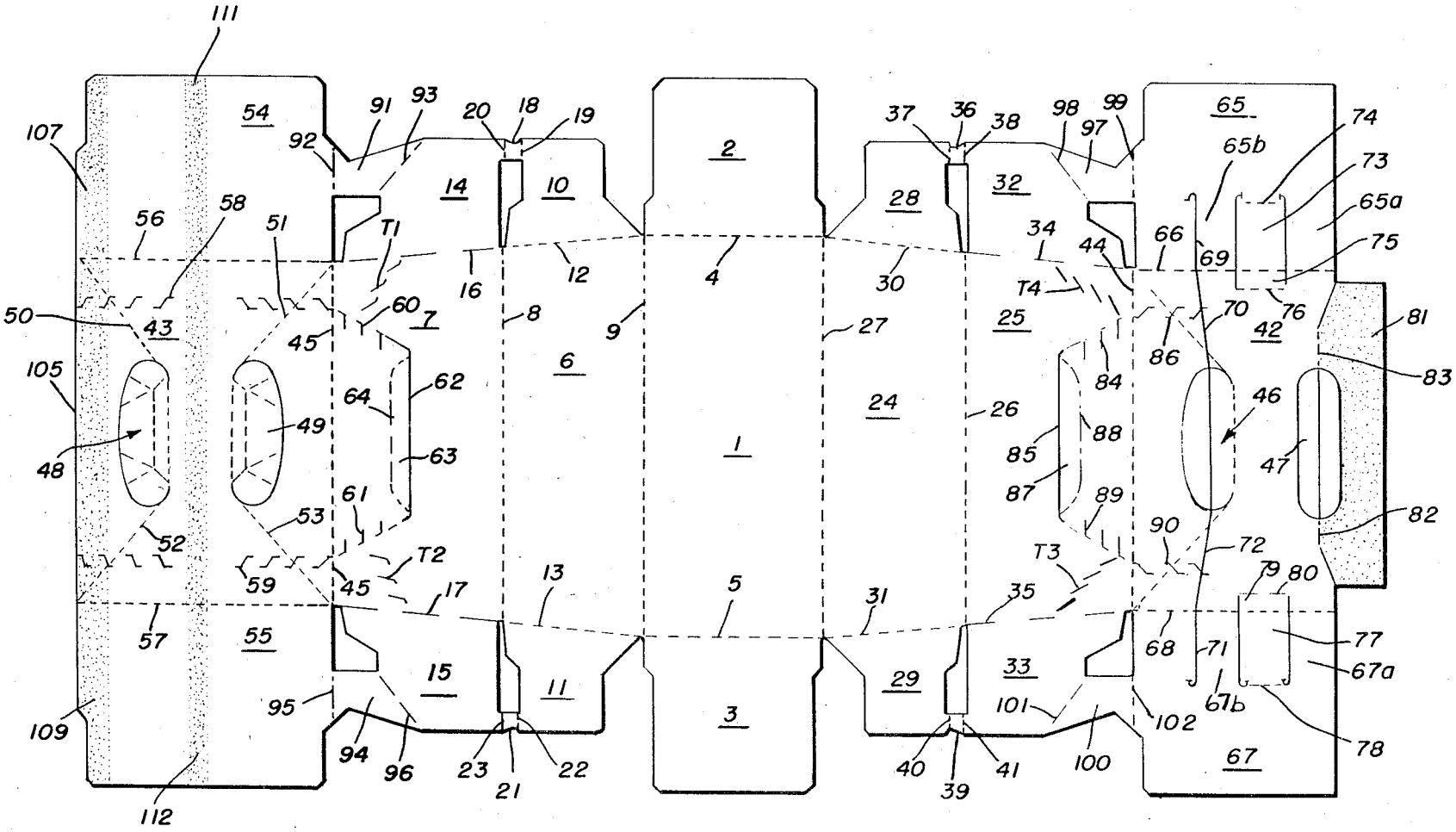
FIG. 1 is a plan view of a blank from which a carton formed according to this invention is formed as viewed from the inner surface of the blank.

With reference to FIG. 1 the numeral 1 designates the bottom wall of the carrier to the ends of which end flaps 2 and 3 are foldably joined along fold lines 4 and 5 respectively. One side wall includes a lower vertically disposed panel 6 and an upper inwardly inclined panel 7 which is foldably joined to vertical side wall panel 6 along fold line 8. Side wall lower panel 6 is foldably joined to bottom panel 1 along fold line 9. End flaps 10 and 11 are foldably joined to the ends of the lower panel 6 along fold lines 12 and 13 respectively while end flaps 14 and 15 are foldably joined to the upper panel 7 of the side wall along fold lines 16 and 17 respectively. End flaps 10 and 11 are interconnected by a tab 18 along short fold lines 19 and 20 respectively. Similarly end flaps 11 and 15 are interconnected by tab 21 by fold lines 22 and 23 respectively.

The opposite side wall is similar and includes a lower vertically disposed panel 24 together with an inwardly inclined upper panel 25 which is foldably joined to vertical panel 24 along fold line 26 and lower panel 24 is foldably joined to bottom wall 1 along fold line 27. End flaps 28 and 29 are foldably joined to the ends of the lower vertical panel 24 along fold lines 30 and 31 respectively. Similarly end flaps 32 and 33 are foldably joined to the inwardly inclined upper panel 25 along fold lines 34 and 35 respectively. End flaps 28 and 32 are interconnected by a small tab 36 which is foldably joined to panels 28 and 32 along short fold lines 37 and 38 respectively. Similarly short tab 39 is foldably joined to end flaps 29 and 33 along short fold lines 40 and 41 respectively.

The top wall of the carrier is a composite structure including an inner panel 42 secured in overlapping relation to outer panel 43. Inner panel 42 is foldably joined to the upper edge of inwardly inclined side wall panel 25 along fold line 44 while outer panel 43 is foldably joined to the upper edge of the inwardly inclined panel 7 along fold line 45. Finger receiving apertures and associated flaps of conventional construction are formed in inner panel 42 and are designated generally by the numerals 46 and 47 while similar finger receiving apertures and their associated flaps are formed in outer panel 43 and are designated generally by the numerals 48 and 49. Yieldable weakened lines 50, 51, 52 and 53 are formed in outer panel 43 and end flaps 54 and 55 are foldably joined to the ends of outer panel 43 along fold lines 56 and 57 respectively. A portion of a tear out panel is defined by tear lines 58 and 59 formed in outer panel 43 together with inwardly inclined tear lines 60 and 61 formed in the upper panel 7 and which communicate with access slit 62 having a flap 63 foldably joined to panel 7 along fold line 64.

At the other end of the blank, an end flap 65 is foldably joined to inner panel 42 along fold line 66 and an end flap 67 is foldably joined to inner panel 42 along fold line 68. A slit 69 is formed in end flap 65 and connects with a slit 70 formed in inner panel 42. Similarly a slit 71 is formed in end flap 67 and connects with a slit 72 formed in the inner panel 42. A yieldable tab 73 is foldably joined to end flap 65 along fold line 74 while a short stub tab 75 is foldably joined to inner panel 42 along fold line 76. The adjacent ends of tabs 73 and 75 are initially interconnected by severable means. At the other end of the carrier yeildable tab 77 is foldably joined to end flap 67 along fold line 78 while short stub tab 79 is foldably joined to inner panel 42 along fold line 80. The adjacent ends of the tabs 77 and 78 are initially interconnected by severable means.

A handle reinforcing panel 81 is foldably joined to inner panel 42 along interrupted fold lines 82 and 83.

For forming a portion of a composite tearaway panel, a tear line 84 is formed in upper wall panel 25 and is connected at one end with access slit 85 and at the other end with a tear line 86 formed in inner panel 42 and which extends to the slit 70. A flap 87 is foldably joined to side wall panel 25 along fold line 88. A tear line 89 is formed in side wall panel 25 and extends from access slit 85 to one end of tear line 90 formed in inner panel 42 and which extends to slit 72.

In addition to the end flaps which are foldably joined to the various bottom, side and top wall panel in order to form end closures for the ends of the carrier, web panel 91 is foldably joined to end flap 54 along fold line 92 and to end flap 14 along diagonal fold line 93. Similarly at the other end of the carrier web panel 94 is foldably joined to end flap 55 along fold line 95 and to end flap 15 along diagonal fold line 96.

At the other side of the carton a web panel 97 is foldably joined to end flap 32 along diagonal fold line 98 and to end flap 65 along fold line 99. Web panel 100 is foldably joined to end flap 33 along diagonal fold line 101 and to end flap 67 along fold line 102.

Figure 1A:
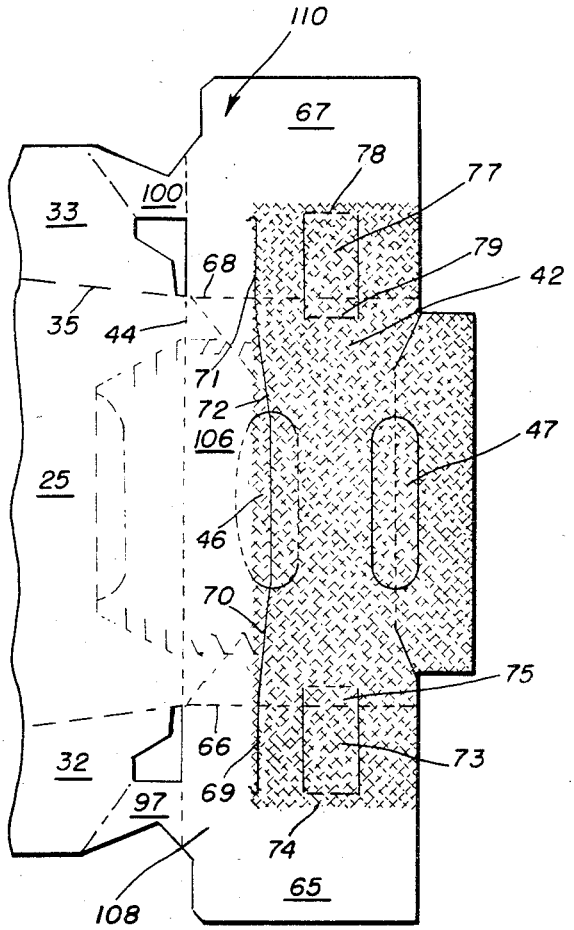
FIG. 1A is a view identical to FIG. 1 except
Figure 5:
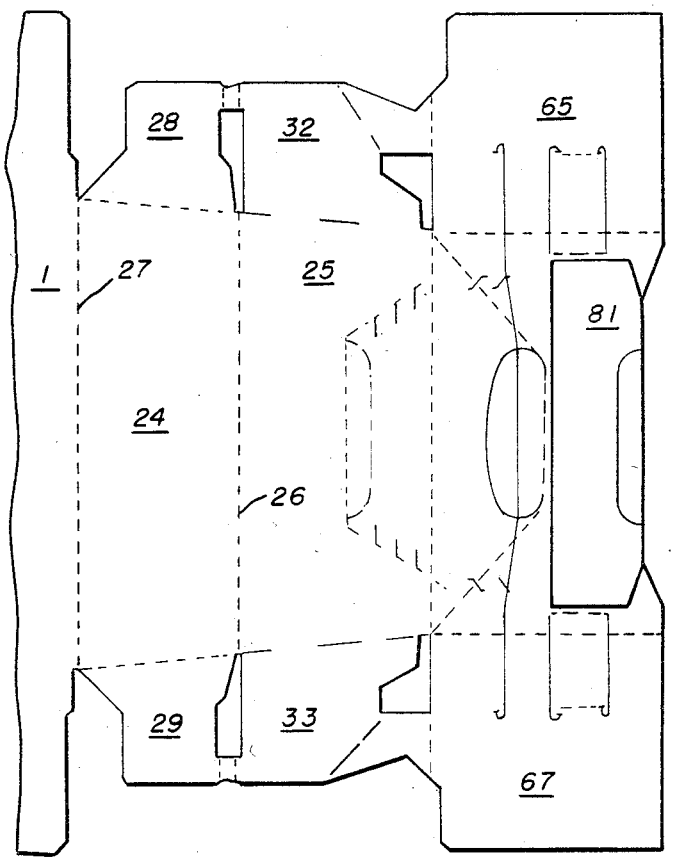
FIG. 5 shows an end of the blank such as is shown in FIG. 1 following the initial folding and gluing operation.

Initially an application of glue is made to the inner surface of reinforcing panel 81 as indicated by stippling in FIG. 1 and an application of varnish is made to the outer surface of the blank as indicated by cross marks in FIG. 1A. Thereafter panel 81 as viewed in FIG. 1 is folded upwardly and to the left along short fold lines 82 and 83 so as to occupy the position shown in FIG. 5. An application of glue is then made to the inner surface of outer panel 43 and to end flaps 54 and 55 as shown by stippling in FIG. 1. Side wall panel 25 together with inner panel 42 and the folded reinforcing panel 81 as viewed in FIG. 1 are then elevated and folded to the left along fold line 26 together with their end flaps. Thereafter the opposite upper side wall panel 7 together with outer panel 43 and their associated end flaps as viewed in FIG. 1 are elevated and folded toward the right along fold line 8. This operation causes the stippled glue area 105 on the inner surface of outer panel 43 to become adhered to the area of inner panel 42 which is located to the right of fold line 44 in FIG. 1A and to the left of the varnished area of panel 42 and designated by the numeral 106. Simultaneously the stippled area 107 on flap 54 becomes adhered to the portion designated 108 in FIG. 1A of end flap 65 between fold line 99 and the left hand edge of the varnished area of end flap 65, while the portion 109 which is stippled and constitutes glue on end flap 55 adheres to the left hand portion of end flap 67 which is located between the fold line 102 and the left hand portion of the varnished area of glue flap 67 and which is designated by the numeral 110 in FIG. 1A.

Figure 1B:
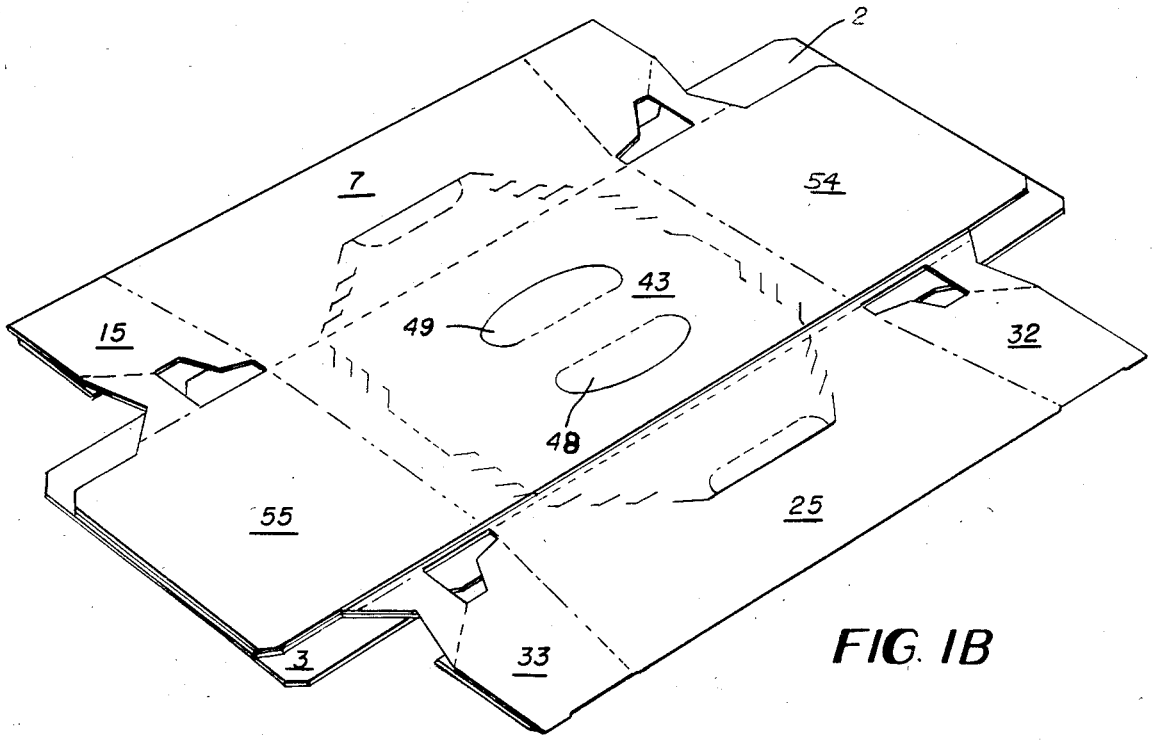
FIG. 1B shows the carrier in collapsed form as produced by the manufacturer.

During this folding operation, the end portion 111 of the stippling applied to glue flap 54 becomes adhered to the outer surface of end flap 65 while the end portion 112 of the stippling applied to end flap 55 becomes adhered to the outer surface of the end flap 65. This operation however forms a very weak bond with the yieldable tabs 73, 75, 77 and 79 as well as with the portion of inner panel 42 which is varnished as indicated by small crosses in FIG. 1A. The collapsed carrier then appears as shown in FIG. 1B.

Figure 2:
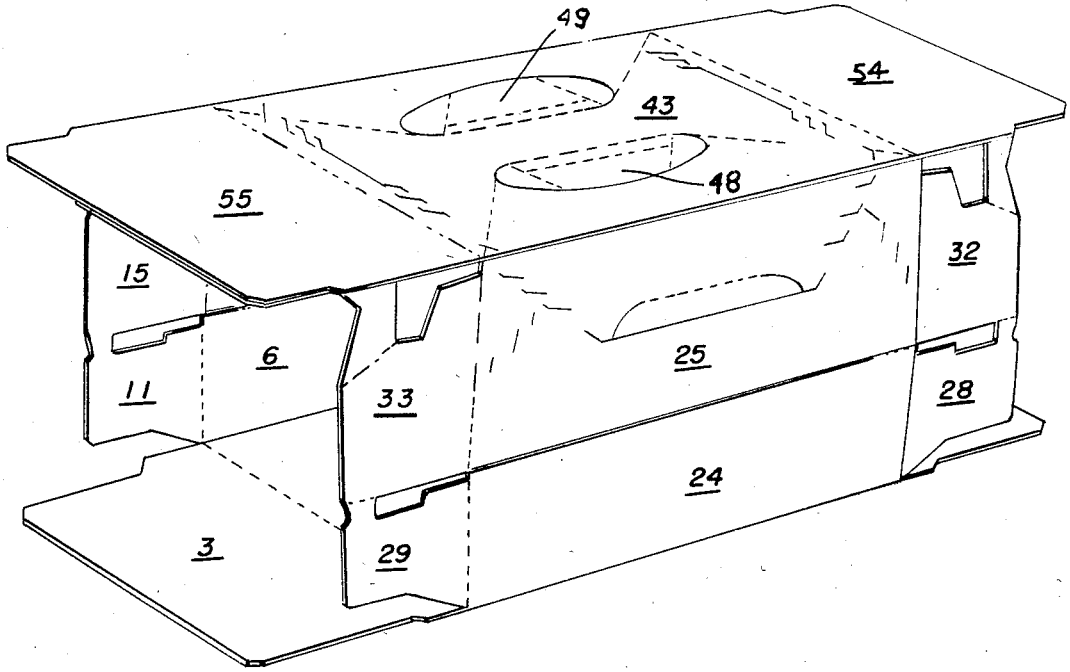
FIG. 2 depicts a partially set up carrier ready for loading through its open ends.
Figure 3:
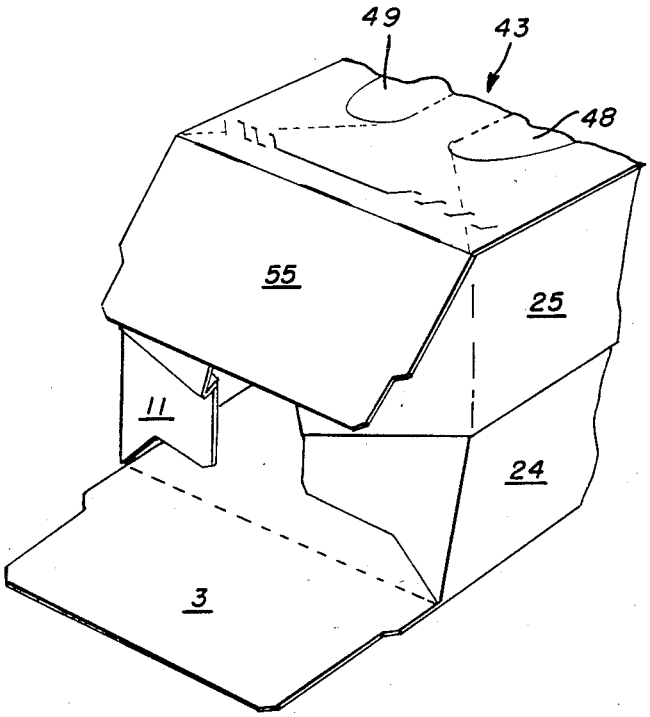
FIG. 3 shows one end of a carrier such as shown in FIG. 2 with the end structure partially closed.
Figure 6:
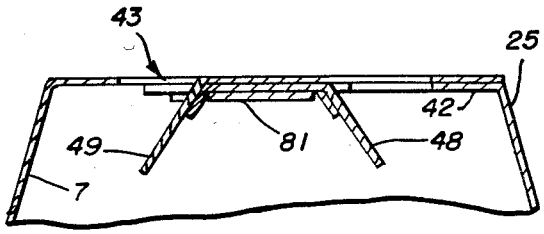
FIG. 6 is a detailed cross sectional view taken along the line designated 6—6 in FIG. 4 with bottles omitted.

With the carrier formed as described above by the carrier manufacturer, it is then shipped to the bottler who sets the carrier up into the position indicated in FIG. 2 and loads filled bottles through the open ends of the carrier. Thereafter the end flaps are folded inwardly as indicated in FIGS. 3 and 4 and the carrier when fully loaded and completed by the bottler appears as shown in FIG. 4 with the upper edge of end flap 3 secured in overlapping glued contact with the lower edge of end flap 55.

The consumer transports the completed package from its point of purchase by simply inserting his fingers into the openings defined by flaps 48 and 49 and the underlying openings formed in conjunction with flaps 46 and 47 and by this means carriers the carton from the point of purchase.

Figure 4:
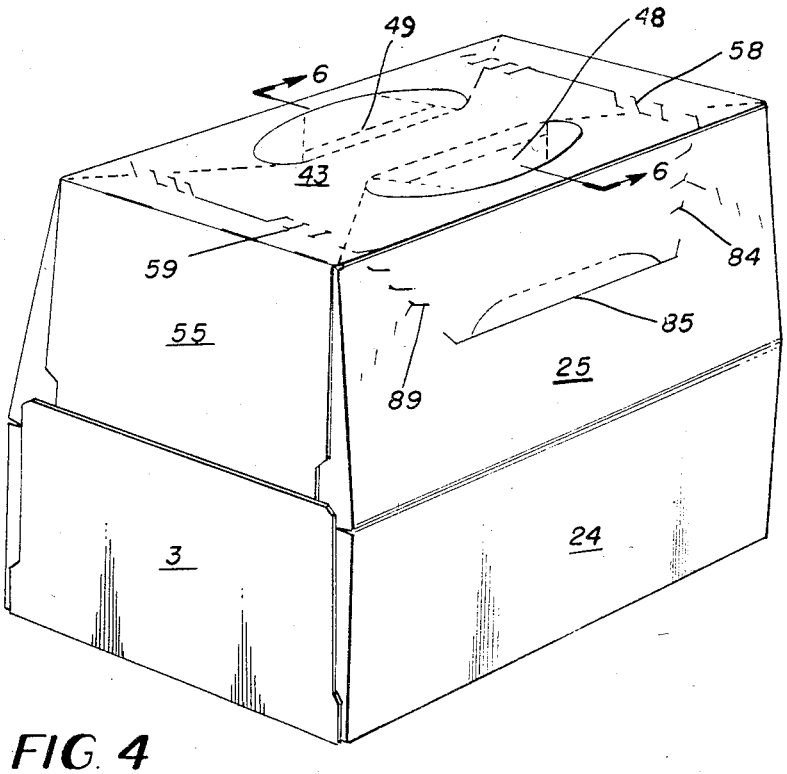
FIG. 4 is a perspective view of a fully enclosed and loaded carrier.

In order to open the carrier, the user's fingers are simply inserted alongside the access slit 85 as best shown in FIG. 4 and an upward force is then applied. Such upward force separates the tearway section defined by tear lines 89, 90, 59 and 61 as well as 84, 86, 58 and 60. This removable section simply is a composite removable section formed of parts of outer panel 43 and of inner panel 42 which are secured together by the glue indicated at stippling 105 as well as part of panel 7 between tear lines 60 and 61 and part of panel 25 between tear lines 84 and 89. Easy separation from reinforcing panel 81 and the portion of inner panel 42 which is disposed to the right of slits 70 and 72 as viewed in FIG. 1 is easily effected due to the bond inhibiting effect of varnish which is applied to the outer surface of the blank as indicated by small cross marks in FIG. 1A. The opened carrier then appears as shown in FIG. 7 and easy removal of the packaged bottles is thus made possible.

Figure 7:
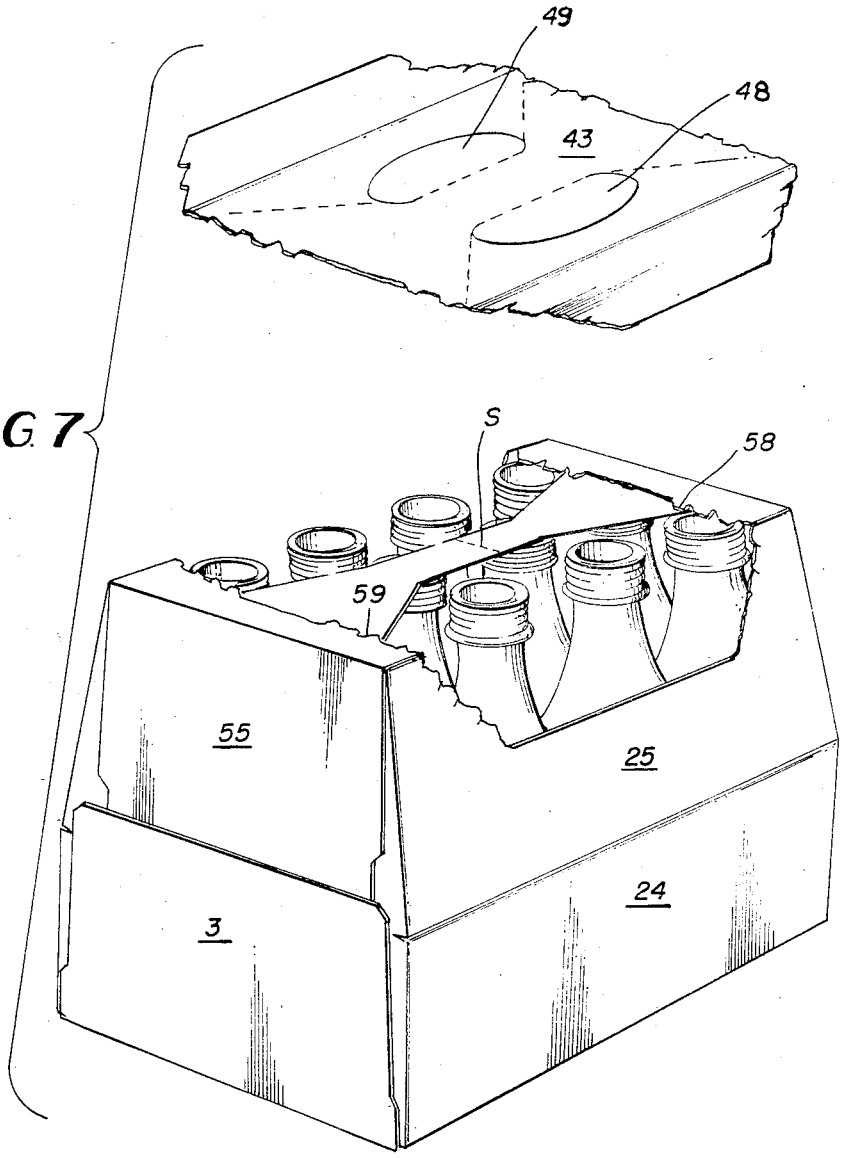
FIG. 7 is a perspective view similar to FIG. 4 but which shows the carrier with a tearaway section removed whereby the carrier is prepared for unloading by the ultimate user of the bottle contents and which also represents the condition of the carrier when used as a vehicle for returning bottles to a point of purchase.
Figure 8:
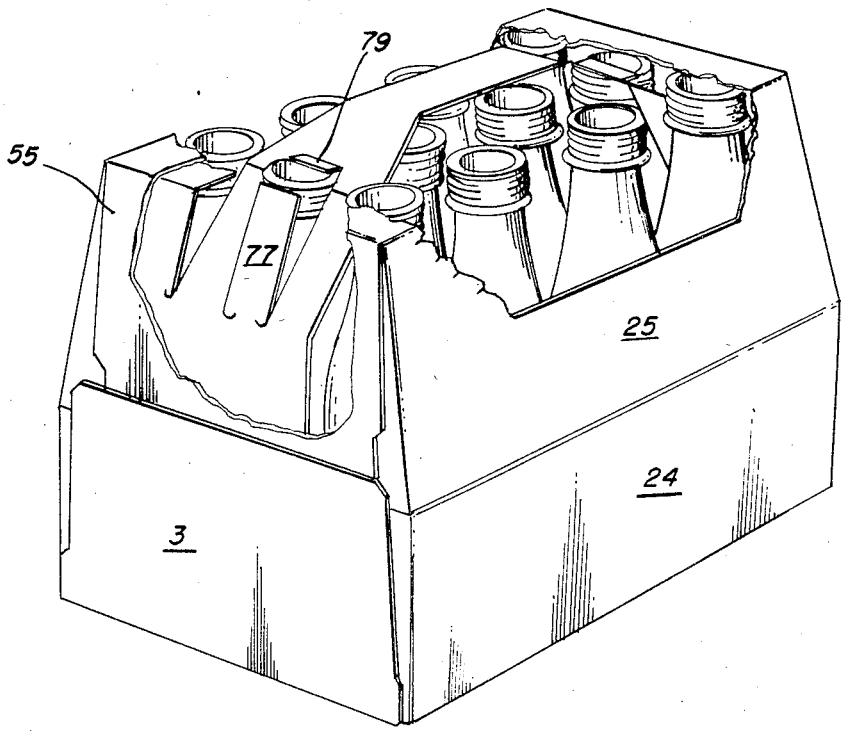
FIG. 8 is a view similar to FIG. 7 with parts exposed to show a feature of the handle.
Figure 9:
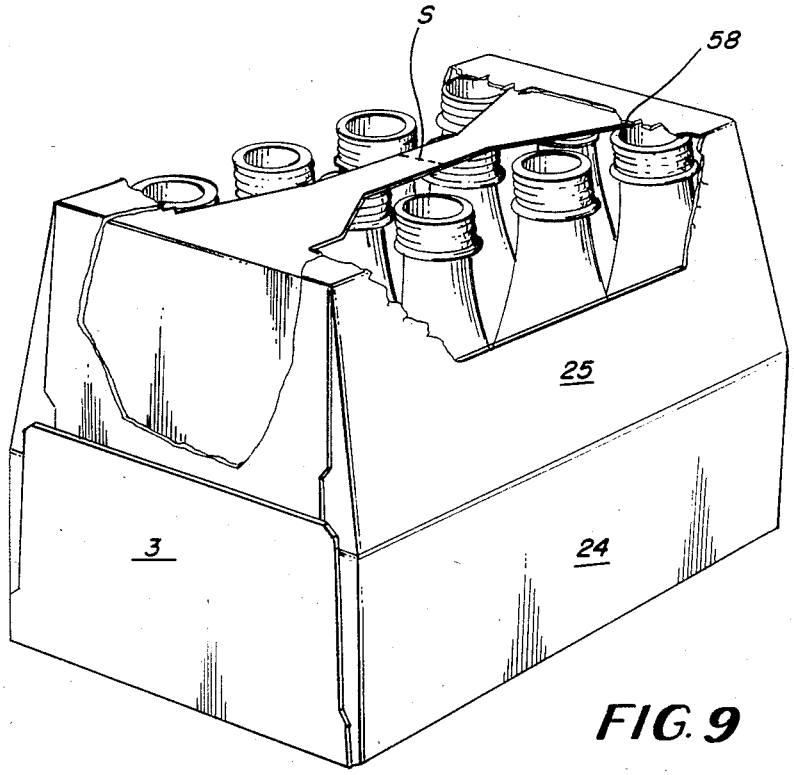
FIG. 9 is a view similar to FIGS. 7 and 8 without the special handle feature of FIG. 8.

After the contents of the bottles have been consumed, the bottles may be replaced into the carrier as shown in FIG. 7 for easy return to the point of purchase. The handle during this operation of course consitutes the reinforcing panel 81 as well as the portions of the inner panel 42 which are disposed to the right of slits 69, 70, 72 and 71 as viewed in FIG. 1 as well as the portions of the flap 65 which are disposed on opposite sides of yieldable tab 73 and designated at **65*a* and 65*b* as well as the portions 67*a* and 67*b* which are on opposite sides of yieldable tab 77. Yieldable panels 73 and 77 allow upward bowing of the handle without applying undue force to the top portions of the end bottles in the middle row of bottles. Tabs 75 and 79 function in a similar manner. If desired tabs 73, 75, 77 and 79 may be omitted as shown in FIG. 9**.

When the package as shown in FIG. 7 is returned to the plant of the bottler, machine removal of the bottles is faciliated by a known procedure wherein the handle is simply severed along the dotted line indicated at S in FIG. 7 and the ends of the handle are folded upwardly and outwardly. Upward and outward folding of the portions of the outer panel 43 which are disposed between the tear line 58 and the fold line 56 as well as the tear line 59 and the fold line 57 is facilitated by tear lines T1, T2 in panel 7 and by similar structure formed as indicated at T3 and T4 in the upper panel 25 of the opposite side wall.

INDUSTRIAL APPLICABILITY

This invention is of particular applicability for use in conjunction with totally enclosed carriers which may be difficult to open by the consumer and is especially adapted for use in conjunction with carriers for returnable bottles.

I claim:

1. A bottle carrier comprising a bottom wall, side walls foldably joined to side edges of said bottom wall, a composite top wall formed of inner and outer overlapping panels foldably joined respectively to the upper edges of said side walls, end closure structure at each end of the carrier including end flaps foldably joined to each end edge of said bottom, side and top walls and folded inwardly and secured in position to close the carton ends, the side edge of said outer panel which is remote from the side wall to which said outer panel is foldably joined being secured in face contacting relation to the side edge of said inner panel which is adjacent the side wall to which said inner panel is foldably joined to form a bonded area therebetween, a bond inhibiting substance applied to a face contacting outer surface area of the inner one of said overlapping panels other than said bonded area to facilitate delamination thereof, a handle reinforcing panel foldably joined to the edge of said inner panel which is remote from the side wall to which said inner panel is foldably joined, said handle reinforcing panel being folded into flat face contacting relation with the inner surface of said inner panel to form a three ply handle, and a tear out section defined by a pair of transverse spaced apart tear lines formed in said outer panel and which extend into the top portions of both side walls and which communicate with an access slit formed in at least one of said side walls whereby removal of said tear out section includes removal of the outer ply of said three ply handle and exposes the remaining two plys thereof.

2. A bottle carrier according to claim 1 wherein said bond inhibiting substance is varnish.

3. A bottle carrier according to claim 1 wherein said bonded area includes cold glue.

4. A bottle carrier according to claim 1 wherein a pair of finger receiving apertures are formed in said outer panel.

5. A bottle carrier according to claim 1 wherein removal of said tear out section results in delamination thereof from said inner panel and access to the packaged bottles.

6. A bottle carrier according to claim 1 wherein the outer portions of the end flaps of said outer and said inner panels are free of a bond inhibiting substance and are glued together in secure face contacting relation so as to anchor a handle forming part of said inner panel.

7. A bottle carrier according to claim 6, wherein a yieldable tab is struck from and foldably joined to parts of said inner panel which are adjacent the tops of the end bottles in the center row of bottles to provide space therefor when the carrier is used to return empty bottles.

8. A bottle carrier according to claim 1 wherein diagonal tear lines are formed at the upper corners of each side wall which communicate with one of said tear lines to accommodate easy upward folding of the end portions of said outer panel thereby to afford ready access to the end bottles at both ends of the carton.

* * * * *